United States Patent [19]

Murphy

[11] 4,421,319

[45] Dec. 20, 1983

[54] HUNTING ARROW WITH LOCATING MEANS

[76] Inventor: Michael R. Murphy, 550 S. DuPont Pkwy., Wilmington, Del. 19720

[21] Appl. No.: 462,937

[22] Filed: Feb. 1, 1983

[51] Int. Cl.[3] ..... F41B 5/02

[52] U.S. Cl. ..... 273/416; 273/213

[58] Field of Search ..... 273/416–423, 273/213, 58 E

[56] References Cited

U.S. PATENT DOCUMENTS

| | | |
|---|---|---|
| 3,150,875 | 9/1964 | Searles . |
| 3,336,530 | 8/1967 | Sloan et al. . |
| 3,790,948 | 2/1974 | Ratkovich . |
| 4,340,930 | 7/1982 | Carissimi . |

OTHER PUBLICATIONS

Aids and Appliances Catalog of American Foundation for The Blind, 18th Edition, 7/72–6/73, p. 10 Aud–A–Ball.

*Primary Examiner*—Paul E. Shapiro

*Attorney, Agent, or Firm*—Connolly and Hutz

[57] ABSTRACT

A hunting arrow comprises a shaft, a tip end, fletching, and a nock having a hollow cavity with arrow locating structure disposed therein. The arrow locating structure includes a normally open electrical circuit having a power source, a time delay, a device for producing an audible signal upon expiration of the time delay countdown, and a switch adapted to close the electrical circuit extending from inside the cavity to the outer side of the nock. Upon actuation of the switch the time delay starts its countdown and upon expiration of such countdown the device for producing an audible signal is energized whereby an audible signal pinpoints the location of the arrow.

8 Claims, 4 Drawing Figures

Fig. 1.
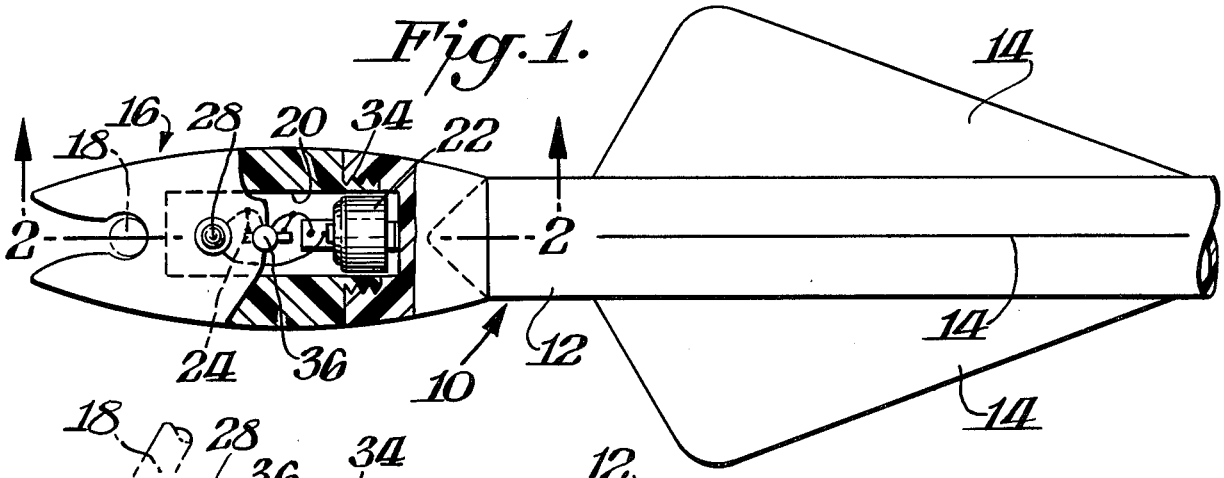
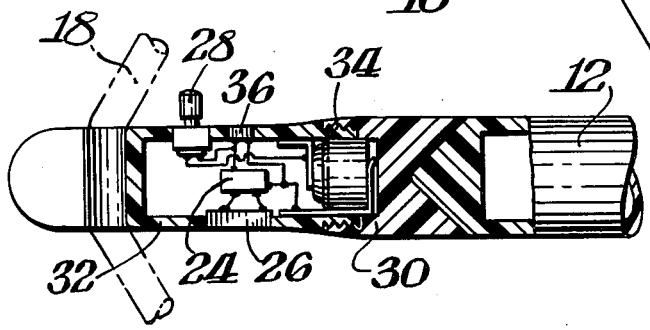
Fig. 2.
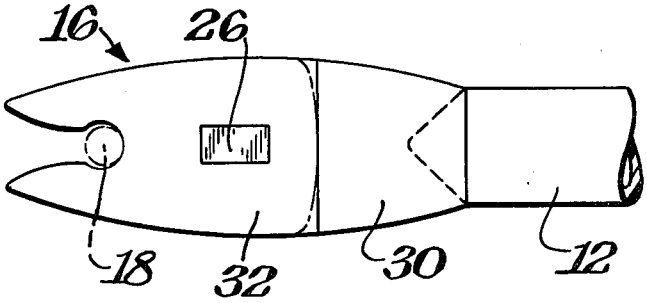
Fig. 3.
Fig. 4.
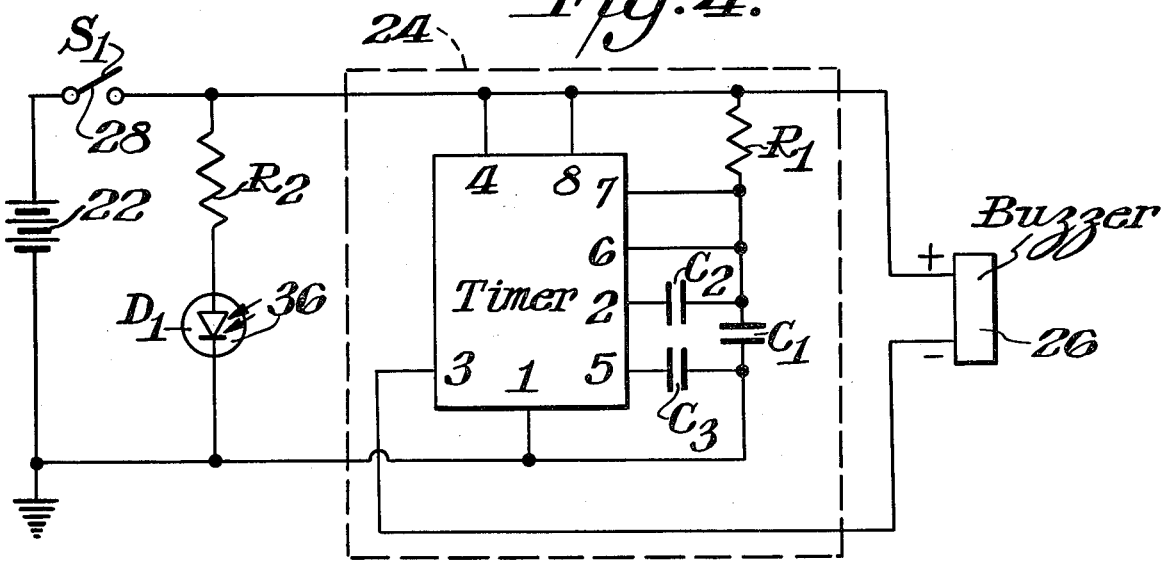

HUNTING ARROW WITH LOCATING MEANS

BACKGROUND OF THE INVENTION

The present invention relates to a hunting arrow, and more particularly to a hunting arrow having arrow locating means associated therewith.

During the hunting of animal game using bow and arrow, it is often difficult to locate the arrow after it is shot from the bow. On many occasions the arrow is lost, particularly when it misses its mark and is ultimately covered by dense brush, fallen leaves, and the like. Also, there are occasions when the arrow is embedded in the animal without an immediate kill and the wounded animal flees the area. Under any conditions, tracking of a wounded animal is quite difficult and such difficulty is significantly increased in areas of dense foliage. Sometimes the wounded animal escapes or ultimately dies in the heavy brush where it is difficult to find. Accordingly, there has been a long felt need for a simple and effective arrangement which makes it easy to locate a lost arrow.

SUMMARY OF THE INVENTION

Accordingly, an object of the present invention is a hunting arrow with locating means associated therewith constructed and arranged to provide an audible signal pinpointing the location of the arrow.

Another object of the present invention is a hunting arrow which is simple to use and which produces an audible signal after a predetermined time lapse or delay.

In accordance with the present invention a hunting arrow includes a nock having a hollow cavity with arrow locating structure disposed therein. The arrow locating structure includes a normally open electrical circuit having a power source, a time delay, and a device for producing an audible signal upon expiration of the time delay countdown. A switch adapted to close the electrical circuit extends from inside the cavity to the outer side of the nock. Upon actuation of the switch the time delay starts its countdown, and upon expiration thereof the device for producing an audible signal is energized so that the audible signal pinpoints the location of the arrow.

The device for producing the audible signal may comprise a buzzer, and the buzzer may extend through the nock to the outer side thereof so that the sound therefrom is directly emitted to the surrounding area. Moreover, the nock may comprise two pieces with a threaded connection therebetween for providing access to the hollow cavity.

Continuing, the arrow locating structure may include a visual indicator connected to be energized when the switch is actuated to thereby indicate the structure is operational and the time delay has started its countdown. The visual indicator may comprise a light emitting diode, or so-called L.E.D.

Preferably the power source is a 4.5 volt battery, and the switch may comprise a single pole, single throw on/off pushbutton.

BRIEF DESCRIPTION OF THE DRAWING

Novel features and advantages of the present invention in addition to those mentioned above will become apparent to those skilled in the art from a reading of the following detailed description in conjunction with the accompanying drawing, wherein:

FIG. 1 is a fragmental top plan view of a hunting arrow, according to the present invention, with portions of the nock broken away to show interior detail;

FIG. 2 is a sectional view taken along line 2—2 of FIG. 1;

FIG. 3 is a bottom plan view of a hunting arrow, according to the present invention; and FIG. 4 is a schematic view of the arrow locating structure, according to the present invention.

DETAILED DESCRIPTION OF THE INVENTION

Referring in more particularity to the drawing, FIG. 1 illustrates a hunting arrow 10 comprising an elongated body or shaft 12, a tip or pointed end (not shown) at the forward portion of the shaft, fletching 14, and a nock 16 connected at the rearward end of the shaft. The fletching is conventionally applied to the shaft 12 and extends radially outward therefrom, as is well known. A bowstring 18 fits within the nock as shown in phantom outline in the drawing.

The nock 16 has a hollow cavity 20 with arrow locating structure disposed therein. As explained more fully below, such structure includes a normally open electrical circuit having a power source 22, a timer 24, and a device 26 for producing an audible signal upon expiration of the time delay countdown. A switch 28 adapted to close the electrical circuit extends from inside the cavity 20 to the outer side of the nock 16. Upon actuation of the switch 28, the timer 24 starts its countdown, and upon expiration thereof the device 26 for producing an audible signal is energized and sound is produced.

Preferably, the nock 16 comprises a front piece 30 and a rear piece 32 having a threaded connection 34 therebetween for providing access to the hollow cavity 20. These nock pieces may be fabricated from theremoplastic material by techniques known in the art The arrow locating structure of the present invention may also include a visual indicator 36 in the electrical circuit. The indicator is connected to be energized when the switch 28 is actuated to thereby provide a visual indication that the overall structure is operational and that the timer has started its time delay countdown. Preferably the visual indicator comprises a light emitting diode, or so-called L.E.D.

The device 26 for producing an audible signal may comprise an electronic buzzer or any miniature sound emitting device. For example, buzzers manufactured by Panasonic and identified as P-type EAL buzzers may be used, such as Panasonic's EAL-030A buzzer. As shown best in FIGS. 2 and 3, the buzzer 26 extends through the nock 16 to the outer side thereof so that the sound generated is directly transmitted to the outside.

The power source 22 may comprise a 4.5 volt battery, and the switch 28 may be a single pole, single throw on/off pushbutton.

The timer or time delay device 26 may be any convenient miniature timer capable of delaying the buzzer from sounding for approximately two and a half minutes. One such timer is the LM 555 timer manufactured for and sold by Radio Shack, a division of Tandy Corporation, Fort Worth, Tex. In the present invention the sole function of the timer 24 is to delay energizing the buzzer 26 after the switch 28 is closed. In the LM 555 timer schematically illustrated in FIG. 4, the resistor $R_1$ and capacitors $C_1$, $C_2$, control the duration of the delay and for purpose of example these components have been selected to provide a delay of two and a half minutes. For example, $R_1$ may be 220 K ohms and $C_1$ and $C_2$, 30 and 100 $\mu$F., respectively. The specific time delay may be changed by altering $R_1$, $C_1$ and $C_2$.

$R_2$ is associated with the L.E.D. and may be 500 ohms. The capacitor $C_3$ may be 0.01 $\mu$F.

In use, when the hunter desires to shoot an arrow 10, the nock 16 thereof is initially positioned against the bowstring 18. The switch 28 is actuated just prior to release of the arrow, such actuation being accomplished by simply depressing the button of the switch which extends outwardly from the nock. Upon actuation of the switch, the visual indicator 36 is energized which signals the hunter that the arrow locating structure is operational and also that the timer 24 has started its countdown. After the countdown, for example two and a half minutes, the timer 24 functions to connect the buzzer 26 to the power source 22 which in turn causes the buzzer to produce an audible signal. In the case of an arrow which has missed its target, the hunter simply walks in the direction of the arrow flight listening for the audible signal pinpointing the location of the arrow. Locating the arrow even when covered by dense brush, fallen leaves, and the like, is an easy task since the hunter simply homes in on the buzzing sound. Also, when the arrow is embedded in the animal game without an immediate kill and the wounded animal flees the area, the hunter tracks the wounded animal and listens for the buzzer sound. Such sound greatly assists in finding the wounded animal and retrieving the arrow.

The timer 24 of the arrow locating structure of the present invention allows the hunter to energize the circuitry while affording him sufficient time to shoot the arrow before the audible device 26 is sounded. This delay feature allows the hunter to make a clean shot absent any noise from the buzzer.

What is claimed:

1. A hunting arrow including a nock having a hollow cavity with arrow locating means disposed therein, the arrow locating means including a normally open electrical circuit having a power source, time delay means, means for producing an audible signal upon expiration of the time delay countdown, and switch means adapted to close the electrical circuit extending from inside the cavity to the outer side of the nock whereby upon actuation of the switch means the time delay means starts its countdown and upon expiration thereof the means for producing an audible signal is energized whereby an audible signal pinpoints the location of the arrow.

2. A hunting arrow as in claim 1 wherein the means for producing an audible signal comprises a buzzer.

3. A hunting arrow as in claim 2 wherein the buzzer extends through the nock to the outer side thereof.

4. A hunting arrow as in claim 1 wherein the nock comprises two pieces with a threaded connection therebetween for providing access to the hollow cavity.

5. A hunting arrow as in claim 1 wherein the arrow locating means includes visual indicator means connected to be energized when the switch means is actuated to thereby indicate the time delay means has started its countdown.

6. A hunting arrow as in claim 5 wherein the visual indicator means comprises an L.E.D.

7. A hunting arrow as in claim 1 wherein the power source is a 4.5 volt battery.

8. A hunting arrow as in claim 1 wherein the switch means is a single pole, single throw on/off pushbutton.

* * * * *